United States Patent [19]

Stanya

[11] 4,240,881

[45] Dec. 23, 1980

[54] ELECTROPLATING CURRENT CONTROL

[75] Inventor: Andrew Stanya, North Royalton, Ohio

[73] Assignee: Republic Steel Corporation, Cleveland, Ohio

[21] Appl. No.: 8,594

[22] Filed: Feb. 2, 1979

[51] Int. Cl.[3] ..... C25D 7/06; C25D 17/00

[52] U.S. Cl. ..... 204/28; 204/211; 204/228

[58] Field of Search ..... 204/211, 228, 28

[56] References Cited

U.S. PATENT DOCUMENTS

| | | | |
|---|---|---|---|
| 2,463,254 | 3/1949 | Edwards | 204/211 |
| 2,471,912 | 5/1949 | Stoltz | 204/211 |
| 2,494,852 | 1/1950 | Winterhalter | 204/211 |
| 2,603,595 | 7/1952 | Rendel | 204/195 |
| 2,734,858 | 2/1956 | Bachman | 204/211 |
| 3,061,534 | 10/1962 | Jasperson | 204/211 |
| 3,371,231 | 2/1968 | Burley | 307/308 |
| 3,564,293 | 2/1971 | Mungenast | 307/252 |
| 3,577,335 | 5/1971 | Blitchington, Jr. | 204/228 |
| 3,622,849 | 11/1971 | Kelley, Jr. | 317/335 C |
| 3,723,285 | 3/1973 | Daga | 204/228 |
| 3,887,452 | 6/1975 | Mannaka | 204/211 |
| 3,962,048 | 6/1976 | Gilbert | 204/28 |

FOREIGN PATENT DOCUMENTS

| | | | |
|---|---|---|---|
| 906031 | 9/1962 | United Kingdom | 204/211 |

*Primary Examiner*—T. M. Tufariello

*Attorney, Agent, or Firm*—Watts, Hoffmann, Fisher & Heinke Co.

[57] ABSTRACT

An automatic plating current control system for an electroplating line. The plating line includes a plurality of power circuits, each including a rectifier and an electrode, for delivering plating current to affect electrodeposition on the workpiece surface.

The automatic control system includes a reference generator, a first feedback circuit for controlling the total plating current applied by all the power circuits and a plurality of second feedback circuits each associated with a different power circuit. Each of the second feedback circuits co-operates with the first feedback circuit for regulating plating current output of the individual power circuits to apportion the current output among the operative power circuits. The reference generator produces a reference signal representing a desired plating current in response to information input to the reference generator, specifying workpiece speed, workpiece dimension and desired plating thickness.

Each power circuit includes an output voltage control and a current metering circuit. The voltage control circuitry is provided for each power circuit to limit its plating current output to a predetermined maximum without disabling the power circuit. Compensation circuitry is provided for altering the reference signal for varying the fraction of plating current apportioned to each power circuit to compensate for inoperability of one or more power circuits.

26 Claims, 5 Drawing Figures

ELECTROPLATING CURRENT CONTROL

BACKGROUND OF THE INVENTION

1. Field of the Invention

This invention relates to an improved method and apparatus for controlling the plating thickness on a metal strip which is passed through an electrochemical plating line.

A typical plating line has a plating bath through which a workpiece to be plated is moved. As the workpiece is moved through the plating bath, it is maintained at a substantially constant electrical potential relative to a number of plating electrodes positioned in the bath. The potential difference is maintained between the plating electrodes and the workpiece by a number of rectifier units.

As the workpiece moves through the bath, electrically charged ions in that bath combine with electrons from the recitifier units to form a plating which coats the workpiece. The number of these combinations of ions and electrons, per unit time, represents the plating current within the plating bath. The total plating current in the plating line is equal to the sum of the plating currents from the individual electrodes or rectifier units.

The magnitude of the plating current is dependent upon a number of system variables. It is known within the art, that the input voltage to the rectifiers, the spacing between the electrodes and the workpieces, and the physical condition of the electrodes, all affect the magnitude of the plating current.

In one typical operation, the workpiece is a strip of steel which is passed through the bath in order that a galvanizing coating of zinc may be deposited on its surface. A coil of un plated strip is unwound, plated in the bath, and then rewound as a plated coil. The details of a typical plating arrangement whose efficiency can be improved by the present invention can be found in U.S. Pat. No. 3,468,783 to Avellone which has been assigned to Republic Steel Corporation and which is incorporated by reference here.

2. Description of the Prior Art

For a strip such as that described in the Avellone patent, and for a given length of travel through the bath, the plating thickness is a function of the plating current, the speed with which the strip moves through the bath, and the physical dimensions of the strip. Since it is the plating thickness that an operator is interested in controlling, the above three factors must be taken into account when setting up plating operations. If, for example, the plating current is the only physical parameter controlled, unintended changes in line speed as the strip moves through the bath will affect the plating thickness in an adverse manner. If the plating current is kept constant and the physical dimensions of the object or workpiece are changed, plating thickness will also change. For these reasons, optimum plating thickness can only be achieved through a close monitoring of not only the plating current but also of the speed of the object through the bath and the physical dimensions of the object.

If the physical dimensions of the object or workpiece to be plated and the speed with which the object or workpiece through the media are known, the proper total plating current for a given plating thickness can be calculated. In the past, these calculations were performed for different combinations of the plating material dimensions and plating line speed, and charts expressing the results of the calculation were provided to inform the operator of the correct plating current.

The use of a chart or tabulation often occasioned errors by the operator when calculating the proper plating current for the optimum plating thickness. Sometimes, an operator, in an effort to increase plating production, would increase the speed with which the workpiece moved through the medium without making the needed adjustments in the plating current.

Even if the operator made accurate adjustments for increased plating current, these adjustments could cause the plating rectifiers to exceed their rated current capability. As the operator attempted to increase the speed with which the product was plated (and thereby increase his production), the plating current was also increased and at some point the capacity of the rectifiers was exceeded. When the capacity of a rectifier was exceeded either a circuit breaker was actuated with resultant reduction in production capacity, or even worse, damage to the rectifier occurred producing a reduction in capacity for a longer period of time.

As noted previously, the plating current can also be adjusted by changing the spacing between the electrodes and the workpiece. As an operator attempted to increase the plating current and therefore his production, he would sometimes reposition the electrodes to a position in closer proximity to the object to be plated. Such readjustment sometimes inadvertently brought the electrode in contact with the plating object, causing a short circuit. The resultant high current levels could damage the connected rectifier unit, with the result that total production decreased rather than increased.

When the plating line included a number of electrodes, it was sometimes possible for the prior user to satisfactorily control total plating current, but he had no way of knowing whether this plating current was being efficiently distributed among the large number of rectifier units on the line. Typically, rectifier current levels vary among the units, due for example to nonuniformity in condition of electrodes. Some operate at or near capacity, while others operate at much lower current. Those operating at high levels carry most of the load while the rectifiers at lower current levels operate inefficiently.

A technique for controlling individual plating current in a plating rectifier has been proposed. The thrust of the proposal, is toward maintaining the rectifiers within safe operating parameters, with no regard to apportionment of plating currents. Specifically, each rectifier unit is current limited to maintain the rectifier operating temperature below a maximum safe operating level. The speed of strip movement is apparently controlled as a function of total plating current while operating parameters are monitored. The proposal does not however, describe the manner of the control.

SUMMARY OF THE INVENTION

The present invention overcomes inefficiencies associated with prior art plating line operations. An apparatus made in accordance with the invention requires no plating charts and eliminates the possibility of operator induced error due to misapplication of those charts. Each of a number of plating rectifiers are automatically controlled so that the total current is correctly provided to achieve proper plating thickness on the work material. The currents are apportioned among the rectifiers thereby producing most efficient rectifier operation. Control circuitry is included to prevent the user from extending each of the individual rectifiers beyond its rated capacity.

The invention provides an automatic system for apportioning a plating current among a number of plating rectifiers. According to the invention, the system includes a first feedback control for regulating the total plating current and a number of secondary feedback control each associated with a different one of a number of plating rectifiers. Each of these secondary feedback controls maintain the proper plating current in each of its associated rectifier. The first feedback control responds to inputs programmed by the user and sends a control signal to each of the secondary feedback controls which control operation of the plating rectifiers.

The output of each of these secondary controls can ultimately affect the size of the inputs to the other secondary control circuits. A change in the output of any feedback circuit affects the input to the other feedback circuits and vice-versa. The result of this circuitry interaction is a controlled distribution of current outputs from each of the rectifiers and a total current output equal to a total optimum value. These features reduce operator decisions regarding plating line operation with the result that fewer operator dependent errors are introduced into the system. The plating rectifier units also share their load in the most efficient manner by proportionally sharing the plating current.

A more specific embodiment of the invention includes a reference generator for providing a control or reference signal. This reference signal interacts with the two feedback control circuits to provide efficient plating line operation. The reference generator includes a speed related signal generator such as a tachometer which produces a signal proportional to the speed with which a workpiece moves along the plating line. A multi-turn reostat serves as a potential divider to reduce the signal from the tachometer in proportion to the width of the product material and the desired thickness of the plating coat. In this way, a reference signal functionally related to the plating speed, width, and thickness is provided. When one of the latter two variables is altered, the operator changes a control dial which varies the potential divider, thereby changing the portion of the tachometer signal sent to the first and second feedback circuits.

Input changes in the plating width and plating thickness, directly affect operation of the first and second feedback circuits. No charts are needed and the potential for operator induced error is substantially reduced. Due to the operation of the feedback circuitry, potential adjustments are made on each of the rectifiers in response to the input changes.

The control signal produced by the control generator is transmitted to the first feedback circuit. According to the preferred embodiment of the invention, the first feedback circuit includes a comparing amplifier for producing an error signal and a summing amplifier for adding the error signal to the control signal. The comparing amplifier receives two inputs, one from the control signal generator and one from a current totalizing amplifier. The current totalizing amplifier receives signals proportional to the current in each of a number of individual plating rectifiers and adds them together to produce an output proportional to the sum of the currents in the rectifiers. This output is compared to the control signal generator output in the comparing amplifier. The comparison produces a signal proportional to the difference between the actual sum of the current in the plating rectifiers and an optimized current as indicated by the control signal generator. This error signal is either positive or negative depending on whether the plating rectifiers are under or over producing in relation to the control signal.

The error signal is added to the control signal from the control signal generator in the summing amplifier. In this way, a modified control signal is produced. The magnitude of this modified control signal is dependent upon operation of the plating rectifiers. If the rectifiers, as a group, are underproducing, the modified control signal will be adjusted to produce a signal proportional to the magnitude of this under production. If the rectifiers are over producing, the modified control signal will give an indication of the magnitude by which they are over producing.

The modified control signal affects operation of the individual plating rectifiers through a number of secondary feedback circuits. Each secondary feedback circuit compares the modified control signal with a signal proportional to the plating current in its associated rectifier circuit. If the particular rectifier associated with a secondary feedback circuit is not producing enough current, its secondary feedback circuit will respond in a manner which will cause the rectifier to produce more current. If, on the other hand, the rectifier associated with the secondary feedback circuit is over producing, the circuit will provide a control signal which will cause the rectifier to produce less current.

The changes provided by either the first feedback circuitry or any of the number of secondary feedback circuits will affect all other circuits within the system. A change in production by any of the rectifiers will affect the modified control signal produced by the first feedback circuit which will in turn affect the output of each of the individual secondary feedback circuits. The feedback circuitry will continue to interact and produce control signals until all rectifiers are producing an optimum current and the total of these currents adds to a current which will produce a proper plating thickness. Once this advantageous state of affairs is reached, it will be maintained so long as no changes occur in operation of the individual rectifiers and the line operator makes no changes in either plating speed, coating thickness, or material width.

The system continues to optimize total current even when one or more rectifiers are incapable of providing their apportioned share. Thus if one rectifier cannot provide its proper current the other rectifiers will provide slightly more than their alotted share to maintain total current optimization.

Should the operator wish to make a change in any of the three independent variables (i.e., speed, width, or thickness), the control generator is modified accordingly. When this procedure is followed, the first and second feedback circuits will automatically adjust to equally apportion the current among the individual rectifiers and produce a total current equal to the current dictated by the change introduced by the operator.

The preferred design includes a number of specialized circuits which add flexibility and efficiency to the invention. The system includes, for example, an automatic/manual switch for changing the operation of the system. When the automatic mode of operation is selected, the first feedback circuit operates in the manner described. When the switch is thrown to the manual position, the first feedback circuit operates in a slightly different manner. When in the manual mode, the first feedback circuit receives a signal from the control generator but does not modify the signal in response to the actual currents appearing in the plating rectifiers. When operating in the manual mode, therefore, each of the secondary feedback circuits receives on unmodified control signal from the control generator.

An inoperative rectifier switch is included in the control signal generator. This switch serves to change the magnitude of the control signal in response to conditions occurring within the plating line. Due to any one of a number of reasons, one or more rectifiers within the line may become partially or totally inoperative. When this reduction in operative rectifiers occurs, the signal from the control generator is modified accordingly.

To so modify its output, the signal generator includes an operational amplifier whose output is variable depending upon the number of rectifiers operating on the line. When a rectifier becomes inoperative, the operator changes the position of a multi-contact switch, thereby increasing the output on the operational amplifier. Should a second rectifier become inoperative, the operator again changes the switch position and again the output of that operational amplifier is increased. When the rectifiers have been repaired and replaced in the operating line the operator shifts the switch back to its original position.

Each of the individualized secondary feedback circuits includes a current limiter circuit which adds to the efficiency of the invention'operation. The current limiter automatically limits to a safe maximum value the amount of current load the associated plating rectifier can produce.

All circuitry included in the invention is analog electronics. The analog electronics is less susceptible to noise and industrial transients which might produce faulty or erroneous signals within a digital circuit. The analog circuitry provides a smooth double feedback current control which automatically responds to operating conditions and to control signals introduced by the operator.

The system also includes a number of current meters which allow the user to monitor the functioning of the system. Each plating rectifier includes a current meter as well as a voltage meter for determining operation parameters of that rectifier. Also included in the system is a meter which is indicative of the total plating current. The operator will be able to monitor the actual total plating current on this meter and compare it to an optimized plating current thereby determining if the system is properly functioning.

From the above it is clear that one object and feature of the present invention is to provide an automatic technique for apportioning a precise total plating current among a number of individual plating rectifiers on a plating line. The system enables the user to automatically input the plating parameters and thereby control the operation of the individual plating rectifiers. The system also provides circuitry for allowing the operator to respond to different operating conditions as those conditions occur. Other features and advantages of the invention will become apparent as the invention becomes better understood when considered in conjunction with the following drawings and detailed description.

DETAILED DESCRIPTION OF THE INVENTION

Figure 1:
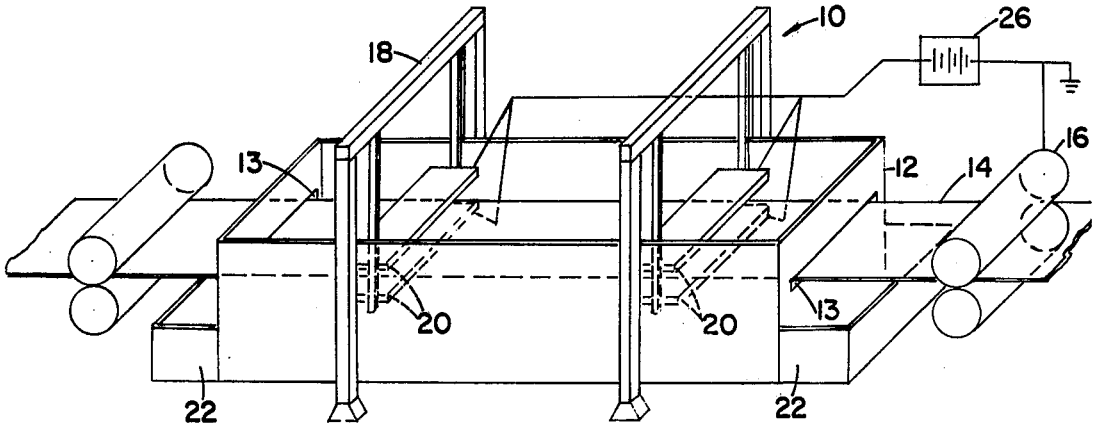
FIG. 1 is a perspective schematic view of a plating line.

A plating line 10 including a vat 12 of plating solution through which a workpiece or sheet of product material 14 passes is shown schematically in FIG. 1. The product 14 is caused to move through the solution by appropriate drive means which have been shown schematically in the diagram as drive rollers 16. Located on either side of the vat are support structures 18 which hold a number of electrodes 20. These electrodes supply a plating current which coats the material or workpiece with a plating film. As the plating material 14 passes through the solution within the vat 12, leakage of the solution through a pair of vat openings 13 occurs. Plating solution leaks down into containers 22 at either end of the solution from these openings. The solution in the containers 22 is periodically returned to the vat 12 and reused.

A source of electrical energy 26 produces a potential difference between the material 14 and the electrodes 20. The rollers 16 are maintained at the same electrical potential as the material 14 by means of a contact between the two at a point exterior to the solution. As shown in the diagram, the rollers are electrically connected to the grounded side of the electrical source 26. Since the material 14 is in contact with the rollers, it also is electrically grounded. The electrodes 20 are electrically connected to the nongrounded potential side of the energy source and therefore are maintained at a potential value other than ground.

As the material 14 passes through the solution, the potential difference between the material and the electrodes 20 causes a plating current to flow in the solution. This plating current might typically be used to produce galvanized steel by depositing a layer of zinc on the plating material 14 which is a sheet of steel. It is the potential difference between the material 14 and the electrodes 20 which causes the plating to occur on the surface of the material 14. The plating current is therefore an indication of how fast the plating process is occurring on the material. A high plating current in the electrodes indicates the plating process is occurring rapidly and therefore the galvanized coat is being deposited at a rapid rate. If all other plating line parameters are unchanged, a higher rate of plating deposition is indicative of a greater plating coat thickness.

In a plating line, the plating thickness should be controlled. It is one object of the present invention to provide an automated means for uniformly depositing a plating of a given thickness upon a sheet of steel or other material by control of the plating current.

Two factors other than the plating current affect the production of the proper plating thickness by the line. These factors are the speed with which the product moves within the solution and the physical dimensions of the product material (typically width). A rapidly moving, wide sheet of product material will require a greater plating current to produce a given thickness than a narrow slowly moving line of product material.

In the present invention, the plating current is chosen to be a dependent variable with the independent variables chosen to be the plating thickness, the material width, and the speed with the material moves through the plating line. The interdependence of plating current with product material speed, material width, and plating thickness is well defined so long as the number of plating electrodes remains a constant. Although only four plating electrodes are depicted in FIG. 1, a typical plating line will include many more than four plating electrodes. In one commercial line such as that disclosed in the Avellone patent there are 34 anodes. The increased number of plating electrodes does not effect the total plating current but does reduce the total plating current for each individual electrode. It is one object of the present invention, therefore, to adjust the plating potentials of each of a number of plating electrodes until those electrodes share the current equally and until the total plating current reaches an optimum value to provide the correct coating thickness.

To achieve a sharing of the plating current among a plurality of plating electrodes, it is necessary that each of the plating rectifiers be maintained at an electrical potential which will produce a plating current which is an appropriate share of the total of all electrode plating currents. The value of the proper plating potential to provide the correct plating current may vary from one electrode to the next. Thus, although the plating electrodes of FIG. 1 are shown connected to one plating potential source 26, it should be appreciated that each individual electrode is energized by an individually adjustable plating rectifier controller (shown in FIG. 5).

The plating control system embodied by the present invention comprises a control or reference signal generator 112, a first feedback circuit 114, and a plurality of secondary feedback circuits 116. The control signal generator provides a control or reference signal 118 to the first feedback circuit. This signal 118 is functionally dependent upon the speed with which the plating line moves, the width of the plating material, the thickness of the desired plating coating, and the number of operating rectifiers sending current to the plating electrodes. This control signal is proportional to the optimum plating current which the totality of the plating rectifier should produce.

In those instances in which the system is not producing enough circuit or in which the system in over producing, the control signal is modified by the first feedback circuit 114. The first feedback circuit receives an input 119 from each of the plurality of secondary feedback circuits. Each of these inputs is proportional to the actual, measured plating current in an associate one of the plating rectifiers. The inputs are summed in a total current amplifier 120 which produces a total actual current signal 122. This signal is sent to a comparator amplifier 130 where its magnitude is compared with the control signal 118 from the control or reference signal generator.

The comparison between the control signal 118 and the total current signal 122 determines how the control signal is to be modified by the first feedback circuit 114. This comparison can produce three possible results. It is conceivable that the plurality of individual plating rectifiers are producing a current which adds to a total plating current precisely correct for the particular plating thickness, width and line speed. If this situation exists, the comparison by the comparator 130 will produce no output signal and no modification is made in the control signal 118.

In the beginning of the plating operation, two other results are more likely to occur. The plating rectifiers are probably either over or under producing. In this non-optimum situation an output 124 from the comparator 130 will produce a signal which is either positive or negative depending on whether the rectifier units are over or under producing. This output is transmitted to a summing amplifier 140 within the first feedback circuit.

The summing amplifier 140 is configured to modify the reference signal 118 from the reference signal generator in response to plating line performance. The summing amplifier 140 has two inputs 141, 142. A first input 141 is the signal from the control signal generator and the second input 142 is the signal from the comparator amplifier 130. As noted previously, if the system happens to be operating correctly and the total plating current is the required value, the input from the first comparator 130 will be 0 volts. In this instance the summing amplifier will leave the other input 141 from the control signal generator unchanged. When a discrepancy occurs between the actual currents and the optimum, the signal from the reference or control generator 141 is modified in order that one or more modified reference signals 144 can be sent to the plurality of secondary feedback circuits 116 so that they may modify the outputs from the plating rectifiers.

The modified control or reference signal 144 is sent to a multi-plexing junction 150 where it is transmitted to each of a number of secondary feedback circuits 16. The multi-plexing junction sends identical signals to each of the secondary feedback circuits in order that the plating rectifiers in each of the plating rectifier circuits are instructed to operate with the same current output.

Figure 2:
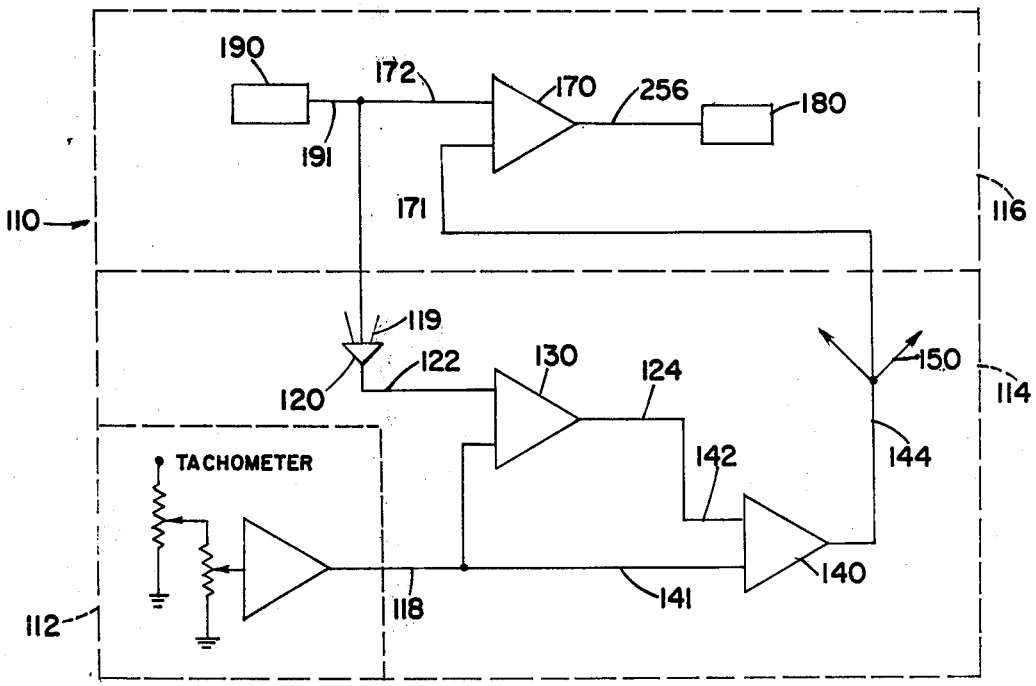
FIG. 2 is a schematic diagram illustrating a feedback plating control circuit.

The secondary feedback circuits 116 control the apportioning of the plating current among the operative plating electrodes 20. The secondary feedback circuits comprise a secondary feedback summing amplifiers 170, a rectifier controller 180, and a current amplifier 190. The summing amplifier has an input 171 from the first or primary feedback circuit and an input 172 from the current amplifier 190. The latter input is directly proportional to the actual current in the electrode associated with the particular secondary feedback circuit. As seen in FIG. 2, the output 191 from the circuit amplifier 190 is also transmitted to the first or primary feedback circuit 114. In this way an input is provided to a total current amplifier 120. That amplifier 120 receives inputs from other current amplifiers 190 in other secondary feedback circuits and provides information concerning the total plating current output to the comparator amplifier 130.

The summing amplifier 170 which comprises a portion of the secondary feedback circuit compares the magnitude of its two inputs and produces an output signal 256 in response to the comparison. This output signal 256 controls the operation of the rectifier controller 180. This rectifier controller in turn determines the voltage appearing at a plating rectifier which is connected to an associated electrode 20. A high input voltage on the rectifier will produce a higher current within the electrode than a low input voltage. Thus, if the particular plating electrode controlled by the secondary feedback circuit is under-producing, the output 256 from the amplifier 170 will cause the rectifier controller 180 to increase the rectifier voltage. If the rectifier is already producing more than enough current, the rectifier 180 will be instructed by the comparator 170 to cut back on its voltage. If the plating rectifier is already producing an optimum current, the output 172 will instruct the plating rectifier controller 180 to maintain the voltage on that rectifier.

The interaction between the first and secondary feedback circuits causes optimum plating current production and a sharing of the plating load among the number of plating rectifiers within the system. The utilization of the two amplifiers 130, 170 insures that not only the total plating current will provide the proper plating thickness, but that each of the individual plating rectifiers is within its operating limits, producing a current equal to the other plating rectifiers.

The functioning of the first and secondary feedback circuits depicted in simplified schematic form in FIG. 2 illustrates some of the advantages and features of the system. It is possible to hypothesize a situation, for example, in which the total system current is less than an optimum value but in which one of the more efficient recifiers was producing a current which is greater than its alloted portion. In this situation, it would be advantageous for the line to produce more total current but for the efficient rectifier to cut back on its current production and allow those inefficient rectifiers to produce more current. The first and second feedback circuits of the present invention will modify current production to accomplish this feat. In the hypothesized situation in which the total current is inadequate to produce the proper plating thickness, the total current summing amplifier 120 produces a signal to the first feedback comparator amplifier 130 causing that amplifier to produce an output 124 whose magnitude is other than zero. This signal would be an input to the summing amplifier 140 which modifies the reference signal from the reference signal generator 112. This modification is then sent to each of a number of secondary feedback circuits to cause the individual plating currents to increase.

It is hypothesized, however, that one efficient plating rectifier is already producing a current in excess of the value required of it. The plating current amplifier 190 associated with that rectifier would produce an input 172 to the comparator 170 indicating this fact. When the signal from the first feedback circuit is compared to the comparator's other input, a signal is produced causing the rectifier controller 180 to decrease the current produced by the efficiently operating plating rectifier. If all other rectifiers are under producing, the signal from the first feedback circuit 114 causes their associated summing amplifiers 170 to increase the voltage on the plating rectifiers and thereby increase the current through the inefficiently operating electrodes.

This example illustrates how the analog electronics of the present invention through a trial and error process which continues as the plating line is operating will produce an optimum plating situation. All plating rectifiers will produce an equal current and this current will add to a total plating current which will provide the optimum plating thickness for the operating characteristics of the plating line.

Figure 3:
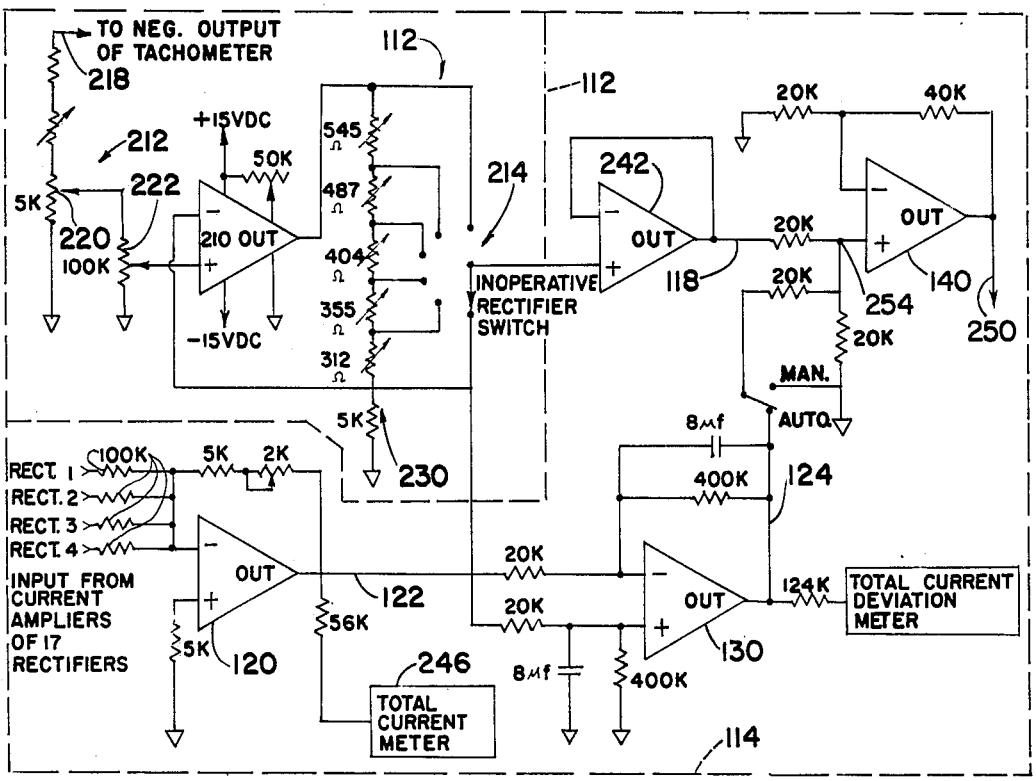
FIG. 3 is a detailed schematic diagram illustrating one portion of the circuit of FIG. 2.
Figure 4:
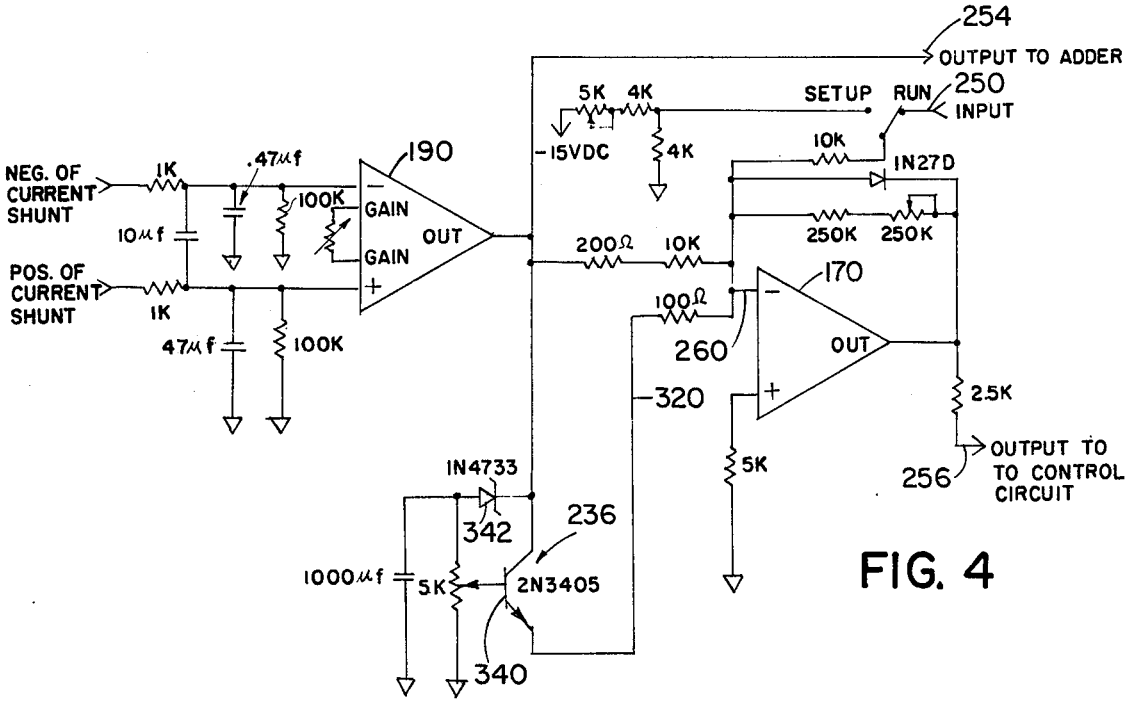
FIG. 4 is a representative chematic diagram of an individual plating rectifier feedback circuit.
Figure 5:
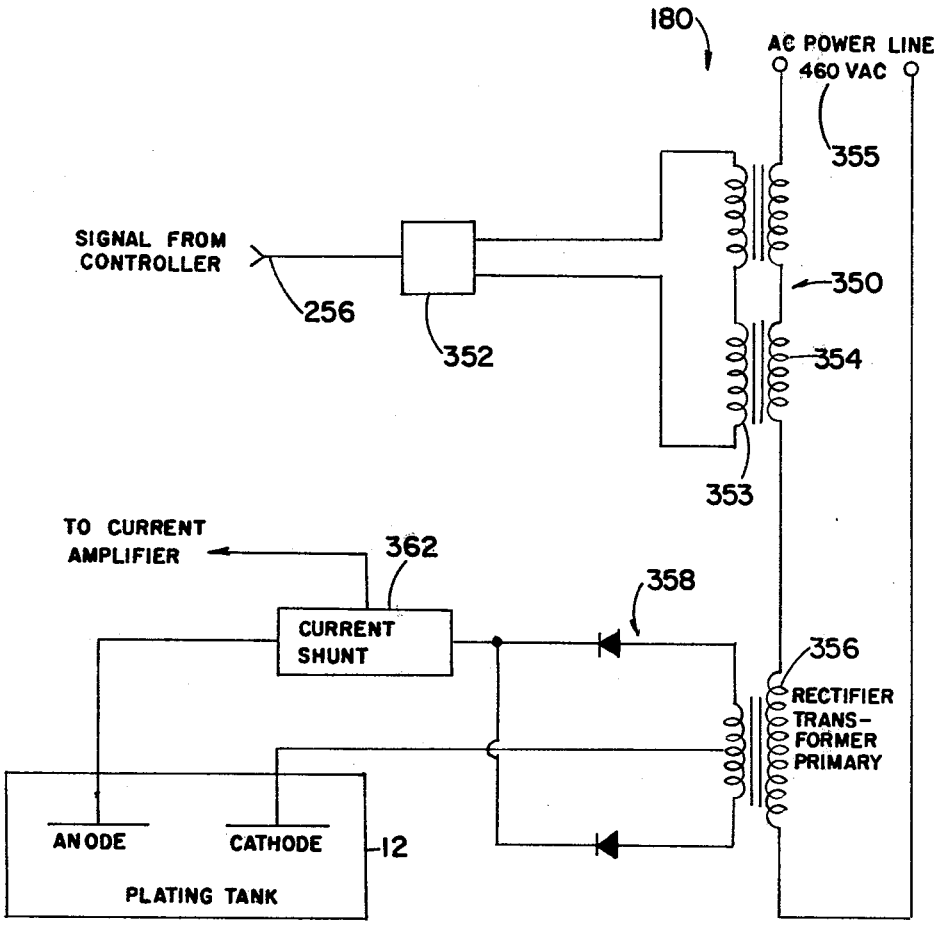
FIG. 5 is a schematic showing the voltage control of an individual plating rectifier.

A detailed schematic for the present control system 10 is illustrated in FIGS. 3, 4 and 5. It should be appreciated that while many of the individual component values have been included in these diagrams, other combinations of components could be utilized in the control system to achieve the improved performance characteristics. As seen in the figures, a number of operational amplifiers are included. It is known that these amplifiers require positive and negative energy inputs as well as trimming resistors. These inputs to the amplifiers have been illustrated for a tachometer amplifier 210 within the reference signal generator 112 but have been omitted from all other system operational amplifiers.

The reference or control signal generator 112 includes an input 218 from a tachometer (not shown). This input receives a voltage signal which varies directly with the speed the drive rollers 16 cause the material to pass through the plating vat. The faster they traverse through the vat, the higher the output voltage created by the tachometer.

The generator 112 further comprises a reostat arrangement 212, an operational amplifier 210, and an inoperative rectifier switch 214. These elements in conjunction with the signal from the tachometer provide a signal which is functionally dependent upon the speed of the motion through the plating vat, the physical width of the plating material, the proper thickness of the coating, and the number of operative rectifiers within the plating system. By altering the position of the inoperative rectifier switch 214 and the tapped resistor arrangement 212, the operator may adjust the optimum signal from the reference generator to correspond to the physical dimensions and operating parameters of the system. These elements in combination obviate the need for a complex or difficult to understand plating chart which causes difficulties in prior art plating systems.

The manual programming arrangement includes two multi-turn reostats 220, 222 for accessing a portion of the signal from the tachometer. These two reostats are variable or adjustable and allow the operator to access a portion of the tachometer signal which can be varied according to the width of the material to be plated and the thickness of the plating coat. In one embodiment of the invention, the first reostat 220 is adjustable depending upon the thickness of the plating coat. For a thick plating coat, the signal sent to the primary feedback circuit should be larger and therefore the operator adjusts the variable reostat 220 accordingly. The second variable reostat 222 is varied according to the width dimension of the material to be coated. For materials of wider dimensions, it is desirable that more plating current be sent from the plating rectifiers and therefore the second variable reostat 222 should be adjusted to send a larger portion of the tachometer signal to the remaining circuitry comprising the system.

An important feature of the arrangement is the manual programming of coating weight and strip width by the user. Each reostat 220, 222 is mechanically connected to a control dial which is calibrated in units of either strip width or coating thickness. The system operator dials in the correct values for these variables and the reostats are automatically adjusted to provide a control signal proportional to the proper width and coating thickness.

Once the tachometer signal has been adjusted according to plating thickness and material width dimensions, that signal is input into the noninverting input of an amplifier 210. This amplifier may conveniently be a Zeltex model ZEL-1. As noted previously, the amplifier has trimming resistors and a positive and negative input for receiving energy. The output from the amplifier 210 is controlled by the inoperative switch 214. The amplifier and switch working in conjunction determine the size of the input signals to two amplifiers 130, 140 in the primary feedback circuit. When all plating rectifiers are operating, the signals to these two amplifiers are identical. When one or more of the plating rectifiers within the system are inoperative, however, the inoperative rectifier switch is switched from a first position in which the signals to the two amplifiers are identical to a second, third, fourth, fifth or sixth positions in which the signal sent to the summing amplifier 140 is greater than the signal sent to the comparator amplifier 130. This indicates that even though the total current produced should remain the same, each operating rectifier will be asked to produce more current by the primary feedback circuit 114. Switching the inoperative rectifier switch to a different position, modifies the reference signal to the comparator 140 to achieve this purpose. As discussed hereinafter, the inoperative rectifier switch is most useful to the system in a so-called manual mode of operation.

By way of specific example, in one embodiment of the invention a reference signal of 5 volts has been chosen to cause each of 17 plating rectifiers to produce a plating current of 5,000 amperes. When all 17 plating rectifiers are operating, this amounts to a total plating current of 85,000 amperes. In a situation in which only 16 plating rectifiers, however, are functioning each of those rectifiers must produce more than 5,000 amperes if the correct plating current of 85,000 amperes is to be achieved. In that instance when one plating rectifiers is inoperative, the signal to a first comparator 130 in the first or primary feedback circuit should remain the same since the total plating current must be unchanged even when one rectifier becomes inoperative. The signal passing through the inoperative switch 238 to the second operational amplifier 140, however, must be adjusted to cause each of the plating rectifiers to produce something more than 5,000 volts. (For 16 rectifiers to produce 85,000 amperes, each rectifier must produce approximately 5,300 amperes). To produce these changes necessitated by inoperative rectifiers, a series of resistors 230 is included between the output from the tachometer amplifier 210 within the reference generator and the inoperative switch. By positioning the inoperative rectifier switch in one of the five alternate positions and by the correct choice of those resistors in the series 230, the reference signal to the summing amplifier 140 is automatically adjusted to produce the proper size signal to control plating current within each of the rectifier units. In an instance where a 5 volt signal is sent to the comparator 130 a signal of approximately 5.312 volts will be sent to the summing amplifier 140.

As seen in FIG. 3, the primary or first feedback circuit 114 includes four operational amplifiers and a number of individual discrete components. Trimming and energizing components have been omitted from these amplifier units. In the embodiment illustrated all amplifiers except the summing amplifier 140 are Zeltex model ZEL-1 amplifiers. The summing amplifier 140 is a Zeltex model ZEL-IC.

A first amplifier 120 is constructed to operate as a summing amplifier. This amplifier receives a number of outputs 254 from the current amplifiers 190 in each of the secondary feedback circuits. When each of the signals from the current amplifiers is summed in the summing amplifier, an output signal 122 is produced which is proportional to the summation of the total plating current within the line. This total plating current is displayed in a total current meter 246 and is also sent to a comparator amplifier 130. In this way a signal directly proportional to the actual plating current is available for comparison with a reference or command signal from the reference signal generator.

A buffer amplifier 242 is included within the primary feedback circuit. The buffer amplifier maintains power transfer from the inoperative rectifier switch 214 to the summing amplifier 140 and does not affect or change the size of the electrical signal passing from the former to the latter.

The primary feedback circuit further includes a manual/automatic switch 244 which is physically located near a noninverting input to the summing amplifier 140. In the automatic mode the output from the comparator amplifier 130 is sent to the summing amplifier 140. When operating in the manual mode, however, no input from the comparing amplifier 130 is sent to that amplifier and therefore no modification in the command or reference signal is made as a result of the comparison between actual and desired current levels.

In the manual mode all rectifiers are programmed to produce identical currents but the total plating current may not be correct because the summing amplifiers 120, 130 do not modify the reference signal. The manual mode is used, for example, if the strip to be plated has wavy edges which cause electrical "short circuits" in the plating tanks when the strip touches the plating anodes. By disabling the feedback signals, these electrical disturbances are not transferred to the rectifier units. It is when no feedback signal is controlling the system (i.e., when the switch 244 is in the manual position) that the inoperative rectifier switch is required. When the system operates in the automatic mode the inoperative rectifier switch has little or no effect since errors in plating current are compensated for by the action of the amplifiers 120, 130.

When operating in the automatic mode, an output 124 from the comparator amplifier 130 is directly added to the output from the buffer amplifier 242. If the output from the comparator is zero, the total current is correct for the physical parameters necessary for correct plating and no modification or change is made in the command or reference signal 118 from the buffer amplifier 242. If a non-zero output from the comparator amplifier 130 occurs, this signal is algebraically added to the command or reference signal to cause the individual plating rectifiers to produce a current other than they are presently producing. This command signal is sent to each of the secondary feedback circuits from the output 250 of the summing amplifier 140.

It is constructive to examine the polarities of the signals which are sent through the first feedback circuitry 114. The tachometer output is negative with respect to ground and is directly proportional to line speed. The control generator includes a non-inverting tachometer amplifier 210, therefore, the signal emerging from that amplifier is also negative. The buffer amplifier does not inver the signal so it is apparent that the control signal occurring at the summing amplifier 140 will always be negative and will vary in size depending upon the plating speed, material width, plating thickness and the number of operative rectifiers. The polarity of the signal passing through the automatic/manual switch, however, will depend upon whether the system is overproducing or underproducing. If the combined plating currents of all rectifiers that are operating is below the optimum signal as indicated by the control or reference generator, the signal passing through the automatic/manual switch 242 will be negative and will add algebraically to produce a larger negative signal at the summing amplifier 140. If, on the other hand, the combined signal 122 indicative of total plating current is larger than the optimum control signal sent by the reference generator, the signal passing through the manual-/automatic switch will be positive and will reduce the size of the output signal from the summing amplifier.

After combination in a summing junction 254, the algebraic sum of the control signal 118 and deviation signal 124 are amplified by the summing amplifier which is a gain of two amplifier. This amplifier sends a modified control signal to each of the secondary feedback circuits. In the automatic mode of operation, this modified signal will be larger than the signal from the control signal generator if the combined rectifiers currents are less than the optimum current signal provided by the control signal generator. The modified signal will be smaller than the control signal generator signal if the rectifiers are producing more current than the optimum signal required by the control signal generator. From the above, it is apparent that the first feedback circuit operates to compare the actual current in the plating rectifiers with the calculated optimum current as produced by the control signal generator. A control signal dependent on the results of this comparison is then sent to each of the individual plating rectifier circuits.

The primary feedback circuit is comprised of analog electronics which provides continuous control of the system's operation. This electronics is less susceptible to transients commonly encountered in an industrial environment. Since the control employs feedback methods, a delay period is introduced in the feedback to allow the plurality of secondary feedback circuits time to respond to the modified command signal. The delay is achieved via a 8 uf capacitor which in conjunction with a 400 kilohm resistor slows down the signal passing through the comparator amplifier 130. This delay gives the secondary feedback circuits time to react to the control signal before that control signal is modified by the output of the comparator 130.

Each of the secondary feedback circuits 116 (See FIG. 4) comprises an input 250, a summing amplifier 170, a current amplifier 190, a current limiter 236, and a first 254 and second 256 outputs. The input signal is from the first feedback circuit 114 and represents a command or reference signal to the secondary feedback circuit. This input can either be modified or unmodified depending on whether the automatic/manual switch is in the automatic or manual mode. In either configuration, the signal will directly control operation of a voltage control circuit 180 associated with the secondary feedback circuit 116. It should be appreciated that the input from the primary feedback circuits goes to a plurality of secondary feedback circuits and the circuit shown in FIG. 4 is representative of those circuits.

The current amplifier 190 provides an output 318 to the summing amplifier 170 which is proportional to the current in its associated electrode and rectifier. In the present embodiment the components controlling operation of the amplifier 190 are adjusted to maintain a voltage output of 5 volts for every 5,000 amperes in plating current from that rectifier. Any current flowing within the rectifier will produce a potential difference across a current shunt 362 which is transformed to positive signal at the output 318 of the amplifier 190.

In normal operation, the output from the current amplifier 190 and the input 250 from the primary feedback circuit are compared at a junction 260 at the inverting input to the summing amplifier 170. The relative size of the two inputs to this junction determine the size of the output 256 from the summing amplifier 170. This output controls the operation of the voltage control circuit 180 (See FIG. 2). The comparison of the two inputs can produce three results. One result occurs when the input from the primary feedback circuit and the input from the current amplifier 190 are identical, the output from the summing amplifier 170 will be maintained at its current value and leave unchanged the output from its associated rectifier circuit.

When the two inputs 250, 254 are unequal, however, the output from the associated rectifier circuit should be altered to produce the proper plating current. If the input from the primary feedback circuit is larger than the input from the current summing amplifier 190, the output from that rectifier circuit should be increased. If, on the other hand, the input 250 from the reference control generator is less than the signal from the current summing amplifier 190, the output from that rectifier should be decreased. As will be seen below, the voltage control device chosen in the present embodiment is only responsive to positive going signals. For this reason the descrete components associated with the summing amplifier 170 have been chosen to limit the output from that amplifier to positive going signals. In particular, a diode on the feedback loop of the amplifier and a 200 ohm resistor on the input to that amplifier effectively control operation of that amplifier to coincide with the needs of the voltage control device. The 200 ohm amplifier is to unbalance the inputs to the summing amplifier 170 and the 1N270 diode insures that only positive going signals are output from the amplifier 170.

Each secondary feedback circuit further includes a current limiter 236. This limiter is designed to limit current through its associated rectifier circuit (see FIG. 5) to a maximum value. In this way, a constraint can be placed upon the system operator which allows him to produce a current up to a maximum value but will not allow him to extend the production capabilities of the line rectifiers beyond their rated capabilities. The current limiter has an input from the current amplifier 190 and an output which is connected to the inverting input of the summing amplifier 170. In the present embodiment the current limiter 236 is constructed to limit current within the plating rectifier to 5,000 amperes. It could conveniently be adjusted or modified to limit the current to some value other than 5,000 amperes.

The current limiter 314 includes a transistor 340 which is turned on and off in response to the output 254 from the current amplifier 190. Operation of the current limiter can best be understood by way of example. Consider an example in which the system operator has asked for too much current from the rectifiers by seeking to achieve a 6,000 ampere output from each rectifier. The current output from the rectifier will gradually rise until it reaches its maximum safe output of 5,000 amperes. This rise in current will be achieved through operation of the voltage control device which will be explained in detail below. As the current from the rectifier rises, the output from its associated current amplifier 190 will also rise until when the current is equal to 5,000 amperes, the output from that amplifier will then be approximately 5 volts. If the current limiter were not inserted within the circuit, the current within each individual rectifier would continue to rise until a 6,000 ampere output were achieved. This output would then stabilize operation of the summing amplifier 170 to produce a stable condition within the voltage control device.

When the output from the current amplifier 190 reaches 5 volts, however, the current limiter 236 is activated and directly controls operation of the summing amplifier 170. The current limiter causes the summing amplifier 170 to respond to the output from the rectifier as though that output is larger than it actually is. In this way the large input signal 250 from the primary feedback circuit is counterbalanced by the actual input 254 from the summing amplifier and a new input 320 from the current limiter.

As the output from the current amplifier 190 rises above 5 volts, a Zener diode 342 in the current limiter circuit allows current to flow through a 5 kilohm resistor. As the current flows through that resistor a voltage drop occurs across the resistor biasing the transistor 340 into a conducting state. When the transistor conducts, a voltage appears at the emitter of that transistor. This voltage adds to the voltage already appearing at the summing amplifier inverting input causing the summing amplifier to sum the algebraic total of its three inputs. The input from the current amplifier 190 adds to the input from the current limiter 236 to exceed the input 250 from the primary feedback circuit. When this occurs, the output from the summing amplifier 170 causes the voltage control device to reduce the current through the rectifier circuit. When this occurs the current limiter again becomes inoperative and its input 320 to the summing amplifier 170 goes to zero. In this way the current limiter 236 limits the output from its associated rectifier circuit to a maximum value and prevents the system operator from exceeding the rated limits of that rectifier. It should be appreciated that the biasing of the transistor 340 within the current limiter could be adjusted to allow the operator to operate at a different maximum current for each rectifier and that this value could be changed if different rectifiers or different capabilities were desired.

One suitable voltage control device 180 is illustrated schematically in FIG. 5. The device receives an output signal 256 from the summing amplifier 170 and in response to that signal controls the voltage produced by a rectifier 358 attached to the electrodes suspended in the vat 12. The particular voltage control device chosen in this embodiment responds to only positive going signals. The output from the summing amplifier 170 is therefore always maintained positive with respect to ground due to operation of the diode and 200 ohm offsetting resistor shown in FIG. 4.

The voltage control device 180 responds to the summing amplifier output by increasing, decreasing, or maintaining the voltage on the plating electrode. If the input to the amplifier 170 from the primary feedback circuit is greater in magnitude than the input from the current amplifier 190, the particular rectifier under control is underproducing and therefore the voltage on that rectifier should be increased. If the primary feedback input is smaller than the current amplifier input to the summing amplifier 170, then the rectifier is producing too much current and the voltage control device 180 should lower the voltage on that rectifier. To perform its control operation, the voltage control device in one embodiment of the invention comprises an alternating current input 355, a control module 352, a saturable core reactor 350 and rectifier transformer 356 which are connected in series, and a rectifier 358. The control module 352 responds to the input from the summing circuit 170 and in response to the input modifies the current passing through the primary winding 353 of a saturable core reactor 350. The saturable core reactor is connected in series with a primary windings of the rectifier transformer and the two in a series are connected across a 460 volt input of alternating current. Since the primary windings of the rectifier transformer present a constant resistance to the alternating current source, changes in the impedance of the saturable core reactor secondary windings 354 change the voltages across the rectifier transformer.

The signals sent to the saturable core reactor from the control module changes the impedance of the secondary windings 354 in the saturable core reactor. This phenomena is best illustrated by way of an example. When the control module sends no direct current through the primary windings of the saturable core reactor, the reactor presents a high impedance to the source. When this occurs most of the input voltage from the source drops across the secondary 354 of the saturable core reactor 350. If 460 volts are provided by the source 355 and no current flows to the primary windings of the saturable core reactor, then approximately 430 volts will drop across that reactor and 30 volts will drop across the primary transformer 356. Through transformer action this 30 volt drop across the primary is converted to a 2.5 volt alternating current across the secondary. When this small voltage is rectified by the rectifier 358, a very small current is produced in the associated electrode with the result that very little plating current is supplied.

To increase the voltage on the plating electrode, it is necessary for the control module 352 to send a fairly large direct current through the primary windings 353 of the saturable core reactor. In this instance the impedance of the reactor drops in relations to the 460 volt input and most of the voltage drop will appear across the primary windings of the rectifier transformer. When a maximum current flows through the primary of the saturable core reactor, only 30 volts of the 460 volt total drop appears across the reactor, the remaining 430 volts appear across the primary of the transformer. The transformer action produces an output of approximately 17 volts which is rectified and sent to the plating electrode. Thus, by changing the current to the primary of the saturable core reactor the control module can alter the voltage appearing at the plating electrode and thereby change the current produced by the particular electrode under control.

The direct current in the primary of the saturable core reactor can be varied continuously from a maximum to a minimum value. The control module responds to input signals from the summing amplifier 170 to produce a current flow in the primary in the saturable core reactor. Various designs might be chosen for the control module so long as an appropriate continuously variable d.c. signal can be provided in response to the output 256 from the summing amplifiers 170. Each electrode in the plating line has its own voltage control device with associated saturable core reactor. Thus, in a system utilizing 34 plating electrodes there will be 34 saturable core reactors and plating rectifier circuits.

Certain components have been included within the plating control system for adding convenience in operation and facilitating system maintenance. A total current meter and as well as a total current deviation meter have been included in the primary feedback circuit (See FIG. 3) to enable the operator to insure that input parameters dialed into the reference or control signal generator produce the proper total current. If they do not, the total current deviation meter will yield a non-zero value. As seen in FIG. 4, each of the secondary feedback circuits includes a setup/run switch 212 which during normal operation of the system is switched to the run configuration. In the setup configuration, however, the switch enables the system operator to access a calibration signal which allows him to fine tune the summing amplifier 170. This switch enables the operator to properly adjust and calibrate the secondary feedback circuits without interrupting plating line operations.

From the above it should be obvious to one skilled in the art that certain modifications in the discrete components of the present system could be made without departing from the scope of the invention. In particular, different operational amplifiers might be chosen to produce similar results and it is possible that design modifications could be made in the voltage control device for producing a voltage to the plating rectifier. Thus, while the present invention has been described with particularity, it should be understood to one skilled in the art that various modifications and design alterations might be made therein without departing from the spirit or the scope of the invention as set forth in the appended claims.

What is claimed is:

1. An automatic plating current control system for a plating apparatus including means for passing a workpiece through a plating bath and a plurality of power circuits for delivering a plating current to the bath, said automatic control system comprising:

(a) a reference generator for producing a reference signal representing a predetermined plating current; and (b) closed loop feedback control circuitry coupled between the reference generator and the power circuits for sensing the total current applied by the power and controlling circuits of said current represented by said reference signal and modifying the current output of said power circuits as a function of the difference between said sensed current and the predetermined current;

(c) said reference generator including means for selectively modifying said reference signal as a function of the number of operative power circuits in said system thereby maintaining the predetermined plating current while adjusting the current output of each operative power circuit.

2. In an automatic plating control system for a plating apparatus including a plating medium bath and a plurality of electric power circuits for delivering plating current through the plating medium to a workpiece, said automatic control system comprising:

(a) generator means coupled to an operator control mechanism and operative to generate a control signal related to workpiece speed through the bath, to the physical dimensions of the workpiece and to desired plating thickness; said control signal representing to an optimum total plating current in said power circuits and appearing at a generator output;

(b) first feedback control circuitry for regulating the total plating current applied by all of said electrical power circuits, and including means for modifying the control signal to indicate the difference between the actual and the optimum plating current in said power circuits; and (c) second feedback control circuitry coupled to the first feedback control circuitry and respectively associated with each of said power circuits for apportioning the delivery of said total current substantially equally among said electrical power circuits by comparing the modified control signal with a current signal representative of current in a power circuit and modified current flow in said power circuit in response to the comparison.

3. A plating system comprising:

(a) a vat for holding a plating medium;

(b) apparatus for moving a workpiece to be plated through the vat containing the plating medium;

(c) a plurality of electrical power circuits each including a rectifier and an electrode for delivering plating current to the plating medium to cause electrodeposition of plating material on the workpiece;

(d) a reference generator for producing a reference signal representing a predetermined total plating current;

(e) circuitry for producing a sum signal which is a function of the total plating current delivered by all of said power circuits;

(f) circuitry for producing an error signal which is a function of the difference between said sum signal and reference signal;

(g) circuitry for adjusting said error signal with said reference signal, and for scaling said adjusted reference signal, representing a desired plating current for an individual power circuit which is a predetermined fraction of said predetermined total plating current;

(h) an output control for each of said power circuits;

(i) an output plating current measuring circuit for each of said power circuits;

(j) power circuit feedback circuitry associated with each electrical power circuit and being responsive to said adjusted and scaled error signal and to said measured plating current for its corresponding power circuit for controlling said power circuit to produce a plating current which conforms to the plating current represented by said adjusted and scaled error signal.

4. A system for controlling the plating thickness to be deposited on an object comprising:

(a) a plating medium for providing a source of electrically charged ions;

(b) a plurality of plating rectifiers for providing a plating current constituting a flow of charged particles to combine with the ions to deposit a plated surface on said object, said flow being a function of the individual plating currents in said rectifiers;

(c) means for propelling said object through the media at a substantially constant speed;

(d) means for producing a reference signal representing an optimum plating current dependent upon a desired plating thickness, the speed of movement, and physical dimension of said object;

(e) a first feedback circuit for summing signals related to said individual plating currents in said plurality of plating rectifiers and comparing that sum with the reference signal to produce a modified reference signal which is a function of the difference between said sum and said reference signal; and (f) a plurality of second individual rectifier feedback control circuits each for comparing said adjusted reference signal with a signal indicative of said individual plating currents for the corresponding rectifier, and producing an individual rectifier control signal for controlling the voltage on said corresponding rectifier in response to said comparison to apportion the plating equally among the rectifiers.

5. The apparatus of claim 4 wherein the producing means produces a control voltage signal proportional to the optimum plating current.

6. The apparatus of claim 5 wherein the first feedback circuit comprises a summing amplifier for totalizing the current in each of the individual rectifiers and producing a total voltage signal proportional to said sum.

7. The apparatus of claim 4 wherein the first feedback circuit further comprises a comparing amplifier for producing an error voltage signal proportional to the difference in magnitude between the reference signal and the total voltage signal.

8. The apparatus of claim 7 wherein the first feedback circuit further comprises an amplifier whose input includes a summing junction for receiving the error voltage signal and the reference signal, said amplifier operative to produce a modified signal proportional to the elgebraic sum of the error signal and the reference signal.

9. The apparatus of claim 4 wherein each second feedback control circuits includes current limiting means for limiting the current within an associated rectifier.

10. The apparatus of claim 9 wherein each second feedback control circuit further includes a shunt circuit for producing a current signal proportional to the current in the associated rectifier.

11. The apparatus of claim 10 wherein each second feedback control circuit further includes a comparator which provides an output signal proportional to the algebraic sum of the modified signal and the current signal.

12. The apparatus of claim 11 where each rectifier control circuit further includes a voltage control device which provides a voltage proportional to the output signal.

13. A control circuit for depositing a predetermined plating thickness on a workpiece moving through a plating line medium including a plurality of plating power circuits, said circuit comprising:

(a) a reference signal generator for producing a reference signal representing an optimum total plating current from information concerning physical dimension of the workpiece, the speed with which the workpiece moves through the medium and the predetermined thickness;

(b) a first feedback circuit including a first comparator means and a first summing amplifier, said summing amplifier operative to sum the plating current contributions of each of a number of plating power circuits and to produce a total plating current representing signal, and said comparator to compare the total plating current signal with the control signal and produce an error signal to be combined with the reference signal thereby producing an adjusted reference signal; and (c) a plurality of secondary feedback circuits, each connected to a different corresponding power circuit and operative to alter the voltages generated by said power circuit, said secondary feedback circuits each including a comparator for comparing said adjusted reference signal with a corresponding rectifier current signal representing the plating current of said corresponding rectifier and for producing a rectifier control signal and said current signal for controlling the current output of the corresponding rectifier as a function of the adjusted reference signal;

(d) said reference signal generator including means for adjusting the reference signal transmitted to the summing amplifier while leaving unaffected the reference signal transmitted to the comparator amplifier; the size of the adjustment dependent on the number of operative rectifiers in the plating line.

14. The control circuit of claim 13 wherein the reference signal generator comprises amplifier means for generating the reference signal proportional to the optimum plating current and wherein the means for adjusting the reference signal comprises a series of resistors coupled between an output from said amplifier means and said comparator amplifier and a multiposition switch for selectively coupling selected ones of said series between the output and the summing amplifier.

15. The generator of claim 16 wherein the second and third means comprise tapped rheostats mechanically connected to calibrated control dials which allow the user to selectively vary the output signal.

16. In a plating control circuit for controlling the plating current to a workpiece in a plating medium, a reference signal generator for producing a reference command signal whose magnitude is selectively controllable by the user comprising:

(a) a first means for producing a preliminary control signal dependent on the speed of the workpiece through the plating media;

(b) a second means operative to selectively transmit a first portion of said preliminary control signal; said means calibrated to allow the user to vary said first portion with the requisite plating thickness of said workpiece; and (c) a third means operative to selectively transmit a portion of said first portion variable and representing the physical dimensions of said workpiece as an output to the plating control circuit.

17. The plating current control apparatus of claim 16 which further comprises an amplifier means for amplifying said portion for producing an output signal proportional to said portion but of increased power.

18. A method for automatically controlling the plating current to a workpiece traveling through a plating line including a number of current supplying electric power circuits comprising the steps of:

(a) providing a control signal related to the workpiece speed through the line, the physical dimensions of the workpiece and desired plating thickness and representing an optimum total plating current in said electric power circuits to a first feedback circuit;

(b) modifying the control signal by combining said control signal with an error signal representing the difference between the actual current in said power circuits and the optimum total plating current;

(c) coupling the modified control signal to a number of secondary feedback circuits for comparing said modified control signal with a current signal indicative of current within an associated power circuit; and (d) controlling the current in each power circuit in response to each comparison to equalize the actual and optimum currents and to minimize the error signal.

19. The method of claim 18 wherein the control signal is functionally related to the physical dimensions of the object to be plated.

20. The method of claim 19 wherein the control signal is functionally related to the speed with which the object moves in the plating line.

21. The method of claim 20 wherein the control signal is functionally related to the desired plating thickness on said object.

22. The method of claim 21 wherein the control signal is functionally related to the number of power circuits providing plating current to said line.

23. Apparatus for automatically controlling the plating current to a workpiece traveling through a plating line including a number of current supplying electric power circuits comprising:

(a) means for providing a control signal related to the workpiece speed through the line, the physical dimensions of the workpiece and desired plating thickness and representing an optimum total plating current in said electric power circuits to a first feedback circuit;

(b) means for modifying the control signal by combining said control signal with an error signal proportional to the difference between the actual current in said power circuits and the optimum total plating current;

(c) means for coupling the modified control signal to a number of secondary feedback circuits for comparing said modified control with a current signal indicative of current within an associated power circuit; and (d) means for controlling the current in each power circuit in response to each comparison to equalize the actual and optimum currents and to minimize the error signal.

24. In a plating control system including a plating medium bath and power circuitry for delivering plating current to said bath a power circuitry control circuit comprising:

(a) an amplifier coupled to said power circuitry for generating a control output to modify said plating current;

(b) first conduction means coupled to said amplifier for transmitting a reference signal proportional to a desired plating current;

(c) second conduction means coupled to said amplifier for transmitting a signal proportional to the actual plating current generated in the power circuitry said control output related to the difference between the desired and actual plating current; and (d) current limiting means coupled to said second conduction means and said amplifier for limiting the plating current to a predetermined maximum value without disabling the power circuitry.

25. The apparatus of claim 26 wherein the current limiting means comprises a transistor which is biased into conduction when the current through the power circuitry exceeds a specified limit; said transistor coupled to the amplifier to insure the signal proportional to actual plating current when combined with a signal from the conducting transistor exceeds the reference signal and reduces plating current through the power circuitry.

26. A control circuit for depositing a predetermined plating thickness on a workpiece moving through a plating line medium including a plurality of plating power circuits, said circuit comprising:

(a) a reference signal generator for producing a reference signal representing an optimum total plating current;

(b) a first feedback circuit including a summing amplifier for generating a total plating current signal representing the total plating current produced by said power circuits, amplifier means to compare the current signal with the reference signal, and means for generating an adjusted reference signal in response to said comparison;

(c) a plurality of secondary feedback circuits, each connected to a different corresponding power circuit and operative to alter the voltages generated by said power circuit, said secondary feedback circuits each including a comparator for comparing said adjusted reference signal with a corresponding rectifier current signal representing the plating current of said corresponding rectifier and for producing a rectifier control signal and said current signal for controlling the current output of the corresponding rectifier as a function of the adjusted reference signal; and (d) delay means coupled between the summing amplifier and the means for generating an adjusted reference signal to allow the secondary feedback circuits to react to the adjusted reference signal more rapidly than the first feedback reacts to the total plating current produced by the power circuits.

* * * * *

UNITED STATES PATENT AND TRADEMARK OFFICE

CERTIFICATE OF CORRECTION

PATENT NO. : 4,240,881

DATED : December 23, 1980

INVENTOR(S) : Andrew Stanya

It is certified that error appears in the above—identified patent and that said Letters Patent is hereby corrected as shown below:

Column 5, line 7, "on" should read -- an --.

line 32, "invention'" should read -- invention's --.

Column 6, line 9, "chematic" should read -- schematic --.

Column 7, line 51, "circuit" should read -- current --;

line 51, "in", second occurrence, should read -- is --.

Column 8, line 35, "16" should read -- 116 --.

line 43, "amplifiers" should read -- amplifier --.

Column 12, line 59, "inver" should read -- invert --.

Column 13, line 2, "242" should read -- 252 --.

Signed and Sealed this

*Seventh* Day of *July 1981*

[SEAL]

*Attest:*

RENE D. TEGTMEYER

*Attesting Officer*

*Acting Commissioner of Patents and Trademarks*